US007527310B2

(12) United States Patent
Shaskey, Sr.

(10) Patent No.: US 7,527,310 B2
(45) Date of Patent: May 5, 2009

(54) APPARATUS TO FACILITATE THE HOLDING OF LARGE BOTTLES WITHOUT INTEGRAL HANDLES

(76) Inventor: Mark S. Shaskey, Sr., 8197 Bodkin Ave., Pasadena, MD (US) 21122

( * ) Notice: Subject to any disclaimer, the term of this patent is extended or adjusted under 35 U.S.C. 154(b) by 687 days.

(21) Appl. No.: 10/671,974

(22) Filed: Sep. 26, 2003

(65) Prior Publication Data

US 2004/0061344 A1 Apr. 1, 2004

Related U.S. Application Data

(60) Provisional application No. 60/413,976, filed on Sep. 26, 2002.

(51) Int. Cl.
*B65D 23/10* (2006.01)

(52) U.S. Cl. ..... 294/31.2; 294/32; 215/396; D7/622

(58) Field of Classification Search ..... 294/27.1, 294/31.2, 33, 32; 215/396; 220/741, 742, 220/758, 759; D7/622, 623
See application file for complete search history.

(56) References Cited

U.S. PATENT DOCUMENTS 357,122 A * 2/1887 Frey ..... 220/741
395,409 A * 1/1889 Waters ..... 248/145.6
1,428,758 A * 9/1922 Cowles ..... 215/11.6
1,702,555 A * 2/1929 Watson ..... 248/145.6
D184,673 S * 3/1959 Frasure ..... D7/622
2,961,112 A * 11/1960 Didion ..... 215/395
4,724,971 A * 2/1988 Henline ..... 215/396
4,896,913 A * 1/1990 Kennedy ..... 294/31.2
4,972,964 A * 11/1990 Escalante ..... 220/741
5,335,954 A * 8/1994 Holub et al. ..... 294/31.2
5,816,631 A * 10/1998 Kochan ..... 294/33
6,378,924 B1 * 4/2002 McCrumb ..... 294/28
6,394,304 B1 * 5/2002 Bohne et al. ..... 220/737

* cited by examiner

*Primary Examiner*—Dean J Kramer
(74) *Attorney, Agent, or Firm*—Ober/Kaler; Royal W. Craig

(57) ABSTRACT

Disclosed herein is a bottle holding apparatus comprising two, short, cylindrical sections, two or more struts fixedly connected between the two cylindrical sections, and a handle and support rib fixedly attached to two of the struts. The bottle holding apparatus of the present invention provides a means for any user to reliably grasp any large, "handle-less" bottle, without causing any inappropriate deformation of the plastic, while dispensing its contents. The present invention's design is simple and scalable, and can be economically manufactured and sold.

7 Claims, 3 Drawing Sheets

APPARATUS TO FACILITATE THE HOLDING OF LARGE BOTTLES WITHOUT INTEGRAL HANDLES

CROSS-REFERENCE TO RELATED APPLICATION(S)

The present application derives priority from U.S. Provisional Patent Application No. 60/413,976, filed Sep. 26, 2002.

BACKGROUND OF THE INVENTION

1. Field of the Invention

The present invention relates to reusable holders for fluid containers and, more particularly, to a reusable bottle holder primarily designed for conventional, large soft drink bottles that do not possess integral handles.

2. Description of the Background

The marketing of soft drink beverages in large, plastic bottles (e.g. 2-liter, 3-liter), that are not equipped with integral handles, is commonplace. Bottles of this type are typically manufactured of relatively flexible plastics such as polyethylene teraphthalate (PET). Although these types of bottles permit a cost effective means for bottling soft drink beverages, there are drawbacks associated with their handling by consumers. Unfortunately, as the contents of a bottle are emptied and replaced by air, particularly when the popular 2-liter bottle is involved, the bottle becomes easily deformable, thus increasing the challenge of holding on to it. This is particularly true with respect to consumers (e.g. children) with smaller-than-average hands. In fact, this deformation may increase to such a degree that the bottle slips from the grasp of the consumer, causing the spilling of the remainder of its contents along with other inconveniences and/or safety hazards.

The present inventor is not the first to address the need for a means of easily maintaining one's hold on large, "handle-less" bottles. Examples of apparatus for this purpose may be found in U.S. Pat. No. 6,378,924 to McCrumb, U.S. Pat. No. 4,972,964 to Escalante, and U.S. Pat. No. 4,724,971 to Henline.

U.S. Pat. No. 6,378,924 to McCrumb discloses a reusable, releasable, bottle holder device for commonly-used bottles. The device includes a pair of rigid, semi-annular plates hingedly mounted to each other along one edge. Each of the rigid plates is pre-formed with a concave curve to receive a bottle. The device includes first and second handle halves attached to an edge of each of the semi-annular plate having at least one pin in the second handle half situated to cooperably engage with at least one ring opening in the first handle half in the closed position. Unfortunately, repeated use of this device can result in material fatigue, and eventually failure, either along the hinged edge of the plates or at the point(s) of cooperative engagement between the pin(s) and the ring opening(s). Failure of the material along the hinged edge would result in the complete separation of the plates while failure of the material at the point(s) of cooperative engagement would result in the inability to hold the device closed around a bottle. Either circumstance renders the device useless.

U.S. Pat. No. 4,972,964 to Escalante discloses a bottle holder comprising a lattice-like structure sized to enclose approximately the lower half of a bottle and having latching means engageable with a portion of said bottle to releasably lock the bottle in the bottle holder.

U.S. Pat. No. 4,724,971 to Henline discloses a handle for use with a bottle of the type having a flange extending circumferentially around the neck of the bottle typically used in the marketing of soft drink beverages. The handle comprises three distinct integral portions, a first ring-shaped holder slips over and around the body of the bottle, a second ring-shaped holder fits over the flange of the bottle when properly positioned and is secured to the bottom surface of the flange, and the gripping portion extending from the first to the second ring-shaped holder.

Unfortunately, in use, the Escalante and Henline apparatus can exert inappropriate forces along the central section of the bottle—the section of the bottle that is the most flexible, or deformable. Inappropriate forces exerted on the mid-section of the bottle can cause the contents of the bottle to unexpectedly gush out of the neck opening resulting in unnecessary spillage.

Therefore, there remains a need for a bottle holder that is not subject to material fatigue/failure and does not contact the bottle along its very flexible mid-section. To the best of the knowledge of the present inventors, no such apparatus exists. An apparatus of this type should, while providing a substantial degree of utility in holding onto a large bottle while dispensing its contents, possess a simple design, be fabricated of strong, lightweight materials, and be economical to manufacture.

SUMMARY OF THE INVENTION

It is, therefore, the primary object of the present invention to provide an improved bottle holding apparatus for large containers that do not possess integral handles.

It is another object of the present invention to provide an improved bottle holding apparatus for flexible plastic bottles.

A further object of the present invention is to provide an improved bottle holding apparatus for flexible plastic bottles having means for releasably locking a bottle within the bottle holder.

Still another object of the present invention is to provide an improved bottle holding apparatus that is not subject to material fatigue or failure.

It is another object of the present invention to provide an improved bottle holding apparatus that does not contact the bottle along its most flexible, or deformable, central section.

It is another object of the present invention to provide a bottle holding device that does not block the view of the user as to the contents of the bottle contained within.

An additional object of the present invention is to provide an improved bottle holding apparatus that is simple in design, light in weight, easy to use, and relatively inexpensive to produce.

These and other objects are accomplished by a bottle holding apparatus comprising two, short, cylindrical sections, two or more struts fixedly connected between the two cylindrical sections, a handle fixedly attached to one of the struts, and one or more support ribs each fixedly attached to others of the struts. The bottle holding apparatus of the present invention provides a means for any user to reliably grasp any large, "handle-less" bottle, without causing any inappropriate deformation of the plastic, while dispensing its contents. The present invention is fabricated of strong, lightweight, metallic and/or plastic materials, such as aluminum or PVC, to provide the durability required by the nature of its usage. The present invention's design is simple and scalable (i.e. it may vary in size to fit various container dimensions/volumes), and can be economically manufactured and sold.

In use, the base of a large, "handle-less" bottle is inserted first through one cylindrical section and then into the second cylindrical section until it comes to rest against an end cap. The user may then remove the cap from the bottle and confidently pick up the bottle and bottle holding apparatus, via its handle, to dispense any amount of the liquid held therein. The configuration of the present invention positions the two cylindrical sections proximate the shoulder and base of the bottle. This minimizes the potential for inappropriate bottle deformation during dispensing because the structural rigidity of the bottle is greatest near its shoulder and base.

BRIEF DESCRIPTION OF THE DRAWINGS

Other objects, features, and advantages of the present invention will become more apparent from the following detailed description of the preferred embodiments and certain modifications thereof when taken together with the accompanying drawings in which.

DETAILED DESCRIPTION OF THE PREFERRED EMBODIMENTS

Figure 1:
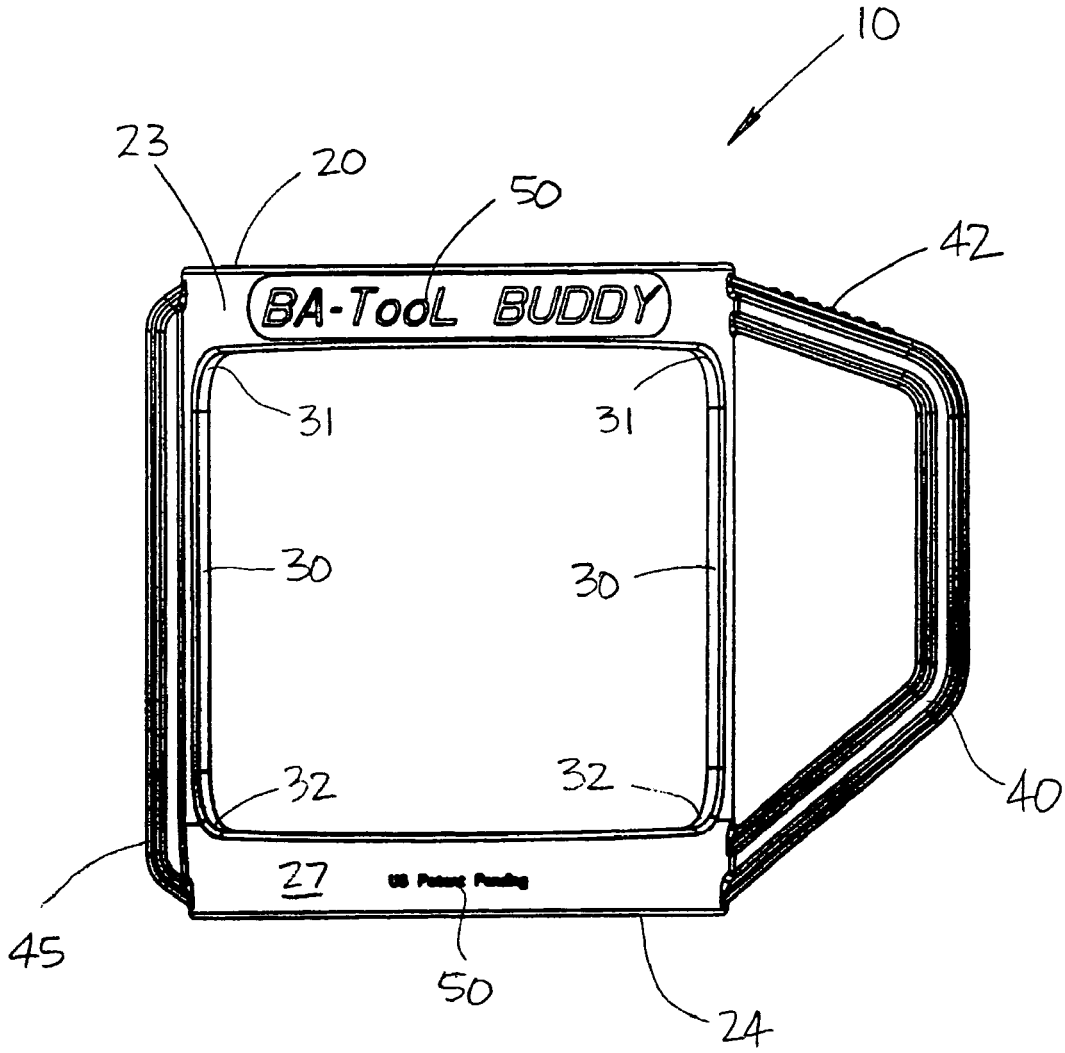
FIG. 1 is a side perspective view of an improved bottle holding apparatus 10 according to a first embodiment of the present invention.
Figure 2:
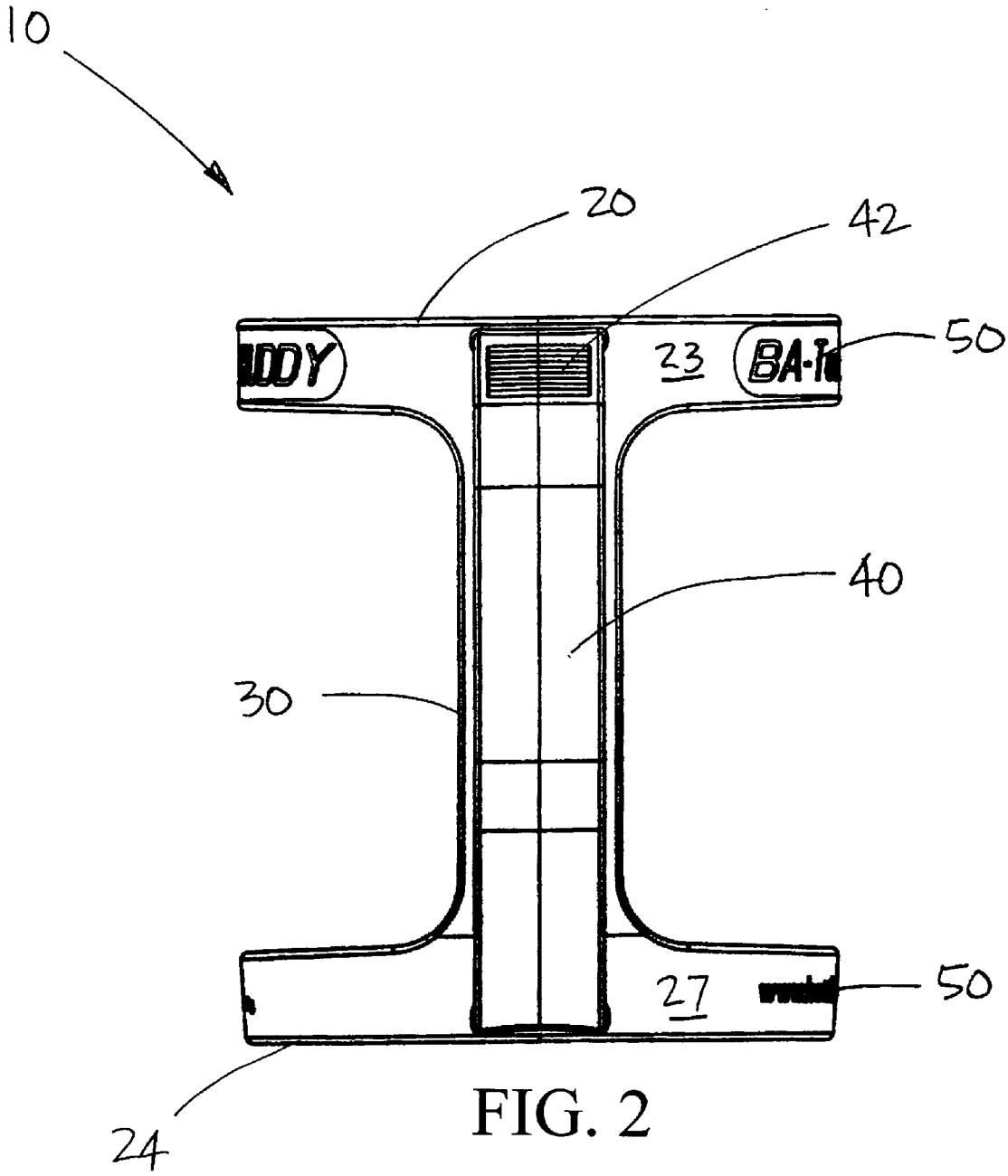
FIG. 2 is a front perspective view of the bottle holding apparatus 10 as in FIG. 1.
Figure 3:
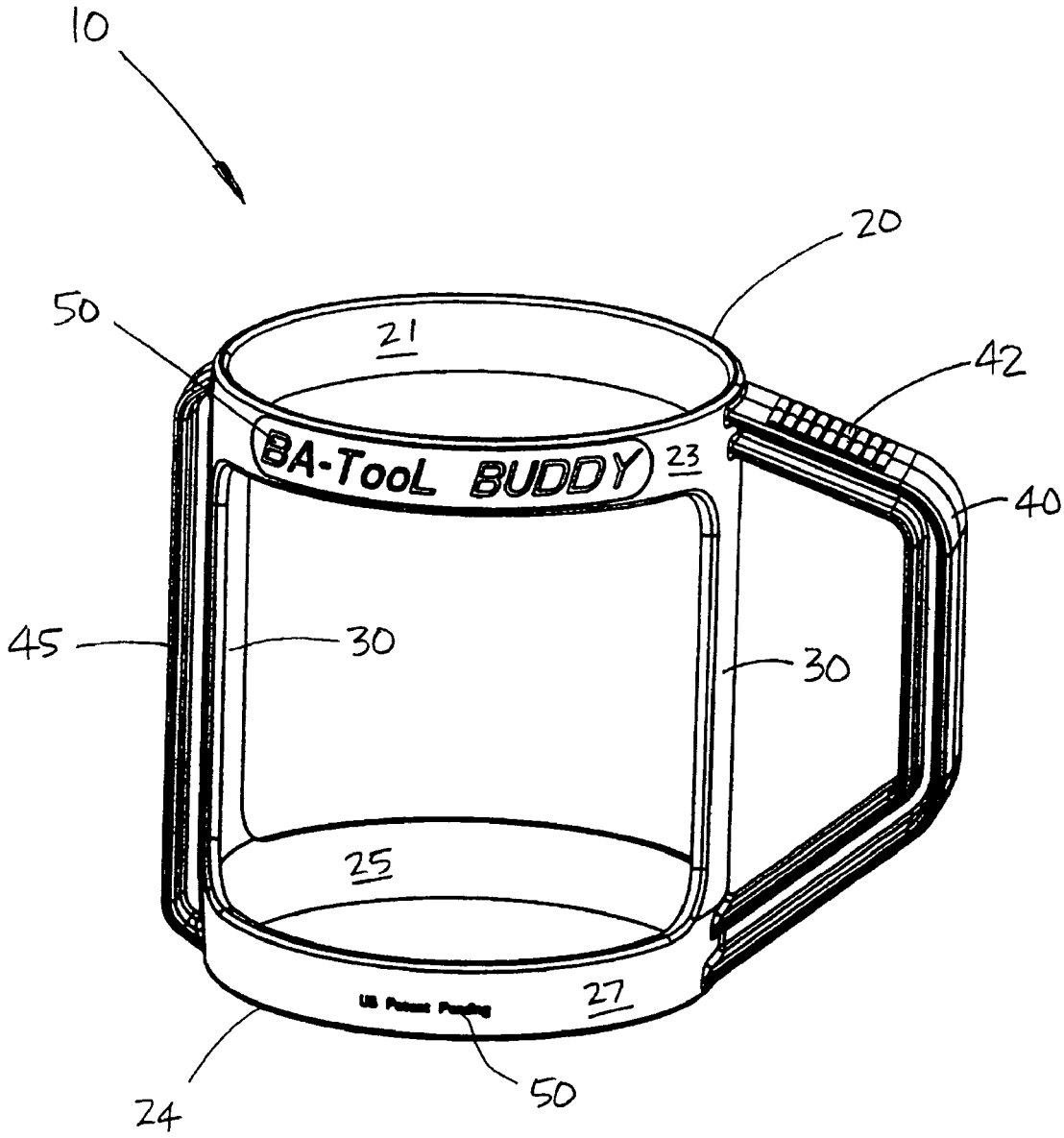
FIG. 3 is an isometric view of the bottle holding apparatus 10 as in FIGS. 1 and 2.

FIGS. 1-3 are, respectively, side, front, and isometric views of an improved bottle holding device 10 according to a first embodiment of the present invention. The first embodiment of the present invention generally comprises cylindrical sections 20, 24, two or more struts 30, a handle 40, and one or more support ribs 45.

The short, cylindrical sections 20, 24 are preferably fabricated of a lightweight metallic or plastic material. The inner surfaces 21, 25, respectively, of the cylindrical sections 20, 24 may be textured to provide means for releasably locking a bottle (not shown in the Figures) within the bottle holding apparatus 10. Additionally, cylindrical section 24 may be formed with a slight inward taper. The "friction fit" between the textured surfaces 21, 25 and the outer surface of the bottle, in combination with the slight inward taper of section 24, maintain the bottle within the holding apparatus 10 during any liquid dispensing cycle. The outer surfaces 23, 27, of the cylindrical sections 20, 24 is used to display text 50 (either molded into the sections 20, 24, or applied in the form of a self-adhesive label) for purposes such as product identification or advertising.

In alternative embodiments of the present invention, section 24 may be closed at one end by an end cap that serves as a stop against which the base of the bottle rests when held within the apparatus 10. Or, the fabrication of section 24 may be such that its diameter is somewhat smaller than that of section 20, thereby maintaining the base of the bottle in an appropriate position.

The cylindrical sections 20, 24 are held in a spaced apart configuration by two or more struts 30. Each strut 30 is preferably fabricated of a lightweight metallic or plastic material. One end 31 of each strut 30 is fixedly connected to section 20 with the opposite end 32 fixedly connected to section 24. When plastic materials of construction are used, the fixed connection may be established by molding the sections 20, 24 and struts 30 as a unitized component, or via the application of a bonding agent. Alternatively, when metallic materials of construction are used, the sections 20, 24 and struts 30 may be fixedly connected via, for example, a plurality of rivets.

As with the other components, the handle 40 and the support rib 45 are preferably fabricated of a lightweight metallic or plastic material. The handle 40 is fixedly attached to one of the struts 30 utilizing, as mentioned above, a molding procedure, a bonding agent, or a plurality of rivets. If molded, the handle 40 preferably has an I-shaped cross-section for maximum durability. The handle 40 may also include a plurality of fixedly attached, transverse raised ribs 42 positioned at the end of the handle 40 proximate cylindrical section 20, both for aesthetics and function. A user may place his/her thumb on the raised ribs 42 to improve his/her grip on the handle 40 during any liquid dispensing cycle.

The support rib 45 is fixedly attached to another of the struts 30 utilizing one of the techniques mentioned. When molded, the handle 40 preferably has a T-shaped cross-section for maximum durability and joins the two cylindrical sections 20 in a shallow arc.

In use, the base of a large, "handle-less" bottle is inserted first through cylindrical section 20 and then into cylindrical section 24 until it comes to rest against the tapered inner surface of section 24. The user may then remove the cap from the bottle and confidently pick up the bottle and bottle holding apparatus 10, via its handle 40, to dispense any amount of the liquid held therein. The configuration of the present invention positions the cylindrical sections 20, 24 proximate the shoulder and base of the bottle. This minimizes the potential for inappropriate bottle deformation during dispensing because the structural rigidity of the bottle is greatest in the areas near its shoulder and base.

Minimizing the height of the cylindrical sections 20, 24, and the number and width of the struts 30, serves to maximize the degree to which the label affixed to the outer surface of the bottle remains visible. Depending upon the nature of the label (e.g. opaque, translucent), this may also allow the amount of liquid remaining in the bottle to be ascertained.

As is readily perceived in the foregoing description, the present invention's design is simple and scalable (i.e. it may vary in size to fit various container dimensions/volumes), may be economically manufactured and sold, and does not possess any pivot or engagement points subject to material fatigue/failure. The bottle holding apparatus 10 of the present invention provides a means for any user to reliably grasp any large, "handle-less" bottle, without causing any inappropriate deformation of the plastic, while dispensing its contents. The present invention is fabricated of strong, lightweight, metallic and/or plastic materials such as aluminum or PVC to provide the durability required by the nature of its usage.

Having now fully set forth the preferred embodiment and certain modifications of the concept underlying the present invention, various other embodiments as well as certain variations and modifications of the embodiments herein shown and described will obviously occur to those skilled in the art upon becoming familiar with said underlying concept. It is to be understood, therefore, that the invention may be practiced otherwise than as specifically set forth in the appended claims.

I claim:

1. A soft drink bottle holding apparatus for providing a handle grip on a flexible two-liter plastic bottle formed with a shoulder and a base, comprising:

a first cylindrical section conforming to said two-liter plastic soft drink bottle shoulder for insertion of said soft drink bottle therein to said shoulder, thereby cradling said soft drink bottle at the shoulder, and a second cylindrical section smaller in diameter than said first cylindrical section and conforming to said soft drink bottle base, said second cylindrical section being formed with an inwardly tapered inner surface for partial insertion of said base therein and for gripping said base by a friction fit to maintain said two-liter plastic bottle therein despite angling of said bottle to dispense liquid;

a pair of struts, each fixedly attached endwise between said first cylindrical section and said second cylindrical section, said pair of struts spanning said first cylindrical section and second cylindrical section on diametric sides thereof, such that said first and second cylindrical sections are rigidly held in a spaced apart configuration;

one or more support ribs, each of said support ribs being fixedly attached to one of said struts;

a handle fixedly attached to one of said pair of struts;

wherein said first cylindrical section and said second cylindrical section are aligned axially thereby creating an apparatus for grasping and dispensing the contents of large, flexible, handle-less two-liter plastic soft drink bottles.

2. The soft drink bottle holding apparatus according to claim 1 wherein said first and second cylindrical sections further comprise outer surfaces suitable for displaying text.

3. The soft drink bottle holding apparatus according to claim 1 wherein said second cylindrical section further comprises an end cap.

4. The soft drink bottle holding apparatus according to claim 1 wherein said handle further comprises a plurality of fixedly attached, transverse raised ribs proximate one end.

5. The soft drink bottle holding apparatus according to claim 1 wherein said first and second cylindrical sections, said pair of struts, said handle, and said one or more support ribs are fabricated of plastic materials.

6. The soft drink bottle holding apparatus according to claim 5 wherein said first and second cylindrical sections, said pair of struts, said handle, and said one or more support ribs are molded as a unitized assembly.

7. The soft drink bottle holding apparatus according to claim 5 wherein said first and second cylindrical sections, said pair of struts, said handle, and said one or more support ribs are assembled using a bonding agent.

* * * * *